United States Patent [19]

Skinner

[11] Patent Number: 4,506,731

[45] Date of Patent: Mar. 26, 1985

[54] APPARATUS FOR PLACEMENT AND RETRIEVAL OF DOWNHOLE GAUGES

[75] Inventor: Neal G. Skinner, Duncan, Okla.

[73] Assignee: Halliburton Company, Duncan, Okla.

[21] Appl. No.: 480,980

[22] Filed: Mar. 31, 1983

[51] Int. Cl.[3] ..... E21B 23/02; E21B 47/06

[52] U.S. Cl. ..... 166/113; 166/250

[58] Field of Search ..... 166/217, 237, 206, 382, 166/66, 113, 322, 250

[56] References Cited

U.S. PATENT DOCUMENTS

| | | | |
|---|---|---|---|
| 3,918,747 | 11/1975 | Putch | 166/217 X |
| 4,051,897 | 10/1977 | Kingelin | 166/113 X |
| 4,149,593 | 4/1979 | Gazda et al. | 166/113 |
| 4,248,300 | 2/1981 | Braddick | 166/217 X |

*Primary Examiner*—James A. Leppink
*Assistant Examiner*—Michael Starinsky
*Attorney, Agent, or Firm*—Joseph A. Walkowski; Thomas R. Weaver

[57] ABSTRACT

The present invention comprises an apparatus for placement and retrieval of gauges employed to measure temperature, pressure and other parameters in a well bore. The apparatus comprises a gauge receptacle means incorporated in a pipe string including a substantially tubular outer housing having a substantially tubular inner housing substantially coaxially therein, the inner housing being supported in the outer housing by a plurality of support rings having longitudinally extending apertures therethrough. The inner housing has a landing nipple profile cut therein, whereby a locking mandrel having a gauge holder secured thereto may be run into the pipe string on a wireline, and locked into the inner housing after which the wireline may be retracted. The locking mandrel may also be subsequently unlocked and retrieved with the gauge holder by wireline.

1 Claim, 5 Drawing Figures

APPARATUS FOR PLACEMENT AND RETRIEVAL OF DOWNHOLE GAUGES

BACKGROUND OF THE INVENTION

The present invention relates to formation testing of a producing formation in an oil or gas well. Formation testing helps determine the potential productivity of a subsurface formation intersected by a well bore. The testing procedure requires the opening of a section of the well bore adjacent the formation to atmospheric or reduced pressure. A "testing string" comprising a string of drill pipe having incorporated therein a tester valve and one or more packers is lowered into the well bore, which may be cased or open hole, with the tester valve closed to prevent entry of well bore fluids into the string. Two packers may be employed if it is necessary to isolate the formation to be tested from the well bore below it. At the desired level, the packer or packers are set to isolate the formation to be tested, and the formation is then exposed to reduced pressure in the empty pipe string by opening the tester valve. The initial ability of the formation to produce fluid is thereby determined, and the tester valve is subsequently closed after a predetermined time period to test the rate of pressure buildup in the formation. This sequence may be repeated several times. At the end of the test, the tester valve is closed, pressure across the packer or packers is equalized, after which they are unset, and the testing string removed from the well. Formation pressures and in some instances other parameters, are recorded by one or more combination measuring and recording devices included in the testing string below the tester valve.

Several prior art methods of measuring downhole parameters are known in the art. The most common utilizes one or more combination measuring and recording devices placed in housings incorporated in the testing string. These devices are activated prior to the string being run into the well, and their proper operation or accuracy cannnot, as a result, be determined until the testing string is pulled from the well bore. Another more recently developed device of the prior art employs a wireline with an actuator sub at the bottom thereof to latch into a measuring device incorporated in the string, whereby a real time readout of the formation parameters measured is obtained at the surface. However, there is again the disadvantage of not being able to replace a faulty or inoperative measuring device without pulling the entire testing string, as well as the possibility that the wireline connection or the wireline itself may short out during the test, a common occurrence due to the hostile environment in the well bore and the long duration of the tests which often extend to several days. A third type of device employed to measure downhole parameters is a so-called "bomb hanger," such as is available from Otis Engineering Corporation of Dallas, Tex., whereby an instrument may be run into the well at the end of a wireline on the bomb hanger and locked into a collar recess on the interior of a pipe string, and retrieved in the same manner. This device, however, does not provide an absolutely positive indication that the instrument is locked in where desired, and also creates a significant flow obstruction when placed in the pipe string. In addition, the relatively large diameter of the bomb hanger precludes it from being run below any reduced diameter portion in a pipe string, such as in a testing string below a ball type tester valve, in close proximity to the formation.

SUMMARY OF THE INVENTION

In contrast to the prior art, the present invention comprises an apparatus whereby downhole measuring and recording devices may be placed and retrieved at will by wireline, even below a ball type tester valve in a testing string. The apparatus comprises a gauge receptacle means which may be incorporated in a testing string or any other pipe string, including substantially coaxial tubular inner and outer housing, the inner housing positioned by support rings having longitudinal apertures therethrough. The inner housing has a landing nipple profile cut therein, whereby a locking mandrel as known in the art having a gauge holder having a measuring and recording instrument therein (hereinafter referred to as a "gauge") and secured thereto may be run into the pipe string on a running tool as known in the art at the end of a wireline and locked into the inner housing. The wireline is then retracted from the well bore until such time as the operator desires to retrieve the gauge holder, at which time the wireline is run into the well bore with a pulling tool as known in the art and the locking mandrel with attached gauge holder is retrieved.

Of course, more than one gauge receptacle means may be incorporated into a pipe string, so that redundancy of gauges may be effected or multiple well bore parameters measured by different gauges.

BRIEF DESCRIPTION OF THE DRAWINGS

The apparatus of the present invention will be more fully understood by reference to the following detailed description of the preferred embodiment, taken in conjunction with the accompanying drawings, wherein.

DETAILED DESCRIPTION OF THE PREFERRED EMBODIMENT

Figure 1A:
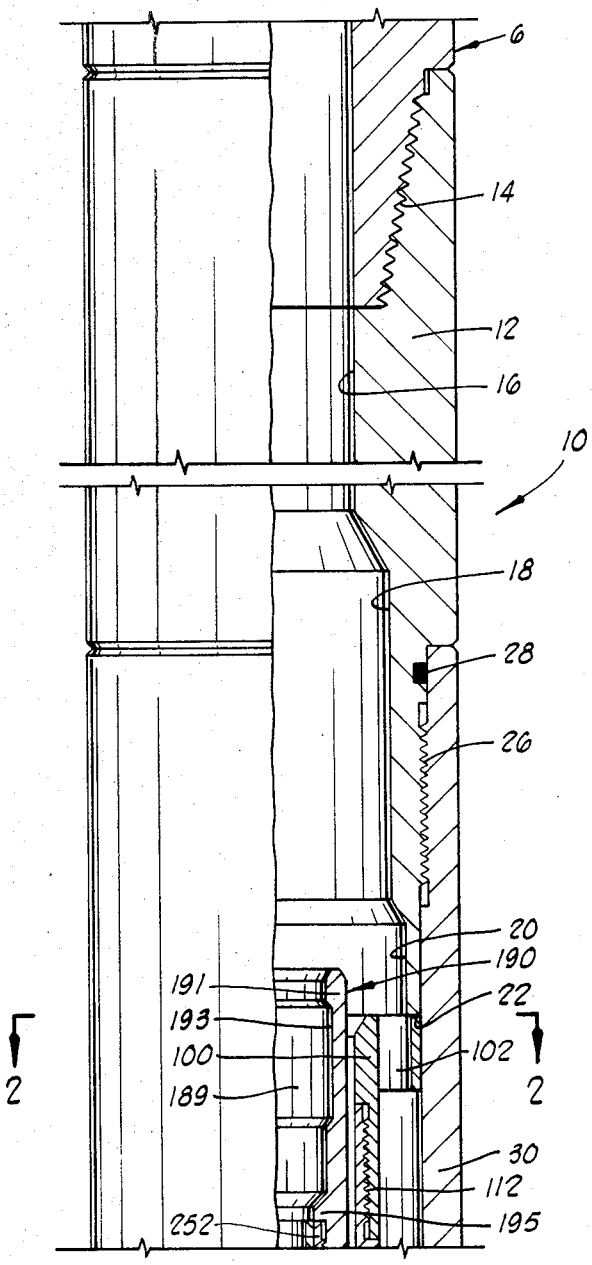
FIGS. 1A–1D are a vertical half-section elevation of the apparatus of the gauge receptacle means of the present invention with locking mandrel and landing and gauge holder in place.

Referring to FIGS. 1A–1D, gauge receptacle means 10 is shown incorporated in a pipe string 6 above and 8 below. The pipe string will be in a well bore, not shown, and may or may not be a part of a "testing string," as previously defined.

Gauge receptacle means 10 of substantially cylindrical and uniform outer diameter comprises an upper adapter 12 which engages pipe string 6 at threads 14. Upper adapter 12 has substantially the same diameter bore 16 at its upper end as that of pipe string 6. Below upper bore 16, the bore enlarges in oblique annular walled steps to intermediate bore 18 and lower bore 20. The lower end of upper adapter 12 comprises annular wall 22.

Upper case 30 is threaded to upper adapter 12 at 26, O-ring 28 effecting a fluid-tight seal therebetween. Case 30 possesses a substantially uniform diameter inner bore defined by bore wall 32, which extends substantially from its top to its bottom (as shown in FIGS. 1A–1D), where it engages middle case 40 at threaded area 34, O-ring 36 creating a fluid-tight seal therebetween.

Middle case 40 possesses an upper extension 42 of slightly less exterior diameter than the interior diameter of bore wall 32, ending at its upper extent in annular wall 44. Below threaded area 34, the exterior of middle case steps radially outward to substantially the same exterior diameter as upper case 30. The interior of middle case 40 is defined by bore wall 46 leading by an oblique annular step to constricted bore wall 48, which communicates radially outward via another oblique annular step with bore wall 50. Bore wall 50 extends to the bottom of middle case 40, where it terminates at a radial annular step 52, leading laterally to recessed bore wall 54.

Lower case 60 is secured to middle case 40 at threaded area 56, O-ring 58 creating a fluid-tight seal therebetween. Like middle case 40, lower case 60 possesses an upper extension 62, which is of slightly less exterior diameter than the interior diameter of recessed bore wall 54, ending at its upper extent in annular wall 64. Below threaded area 56, the exterior of lower case 60 steps radially outward to substantially the same exterior diameter as middle case 40. The interior of lower case 60 is defined by bore wall 66 leading by an oblique annular step to constricted bore wall 68, which communicates radially outward via another oblique annular step with bore wall 70. Bore wall 70 extends to the bottom of lower case 60, where it terminates at a radial annular step 72, leading laterally to recessed bore wall 74.

Lower adapter 80 is secured to lower case 60 at threaded area 76, O-ring 78 creating a fluid-tight seal therebetween. Like middle case 40 and lower case 60, lower adapter 80 possesses an upper extension 82 of slightly lesser exterior diameter than the interior diameter recessed bore wall 74, and terminates in an annular wall 84 at its upper extent. Below threaded area 76 and O-ring 78, lower adapter 80 steps radially outward to an exterior diameter substantially the same as that of the rest of gauge receptacle means 10. The interior of lower adapter 80 is defined by upper bore wall 83, which extends via an oblique annular step to constricted bore wall 85, which in turn terminates at an oblique annular step in exit bore wall 86, of substantially the same diameter as that of pipe string 8 to which it is threaded at 88. Upper adapter 12, upper case 30, middle case 40, lower case 60 and lower adapter 80 together comprise substantially tubular outer housing 90 of gauge receptacle means 10.

Figure 2:
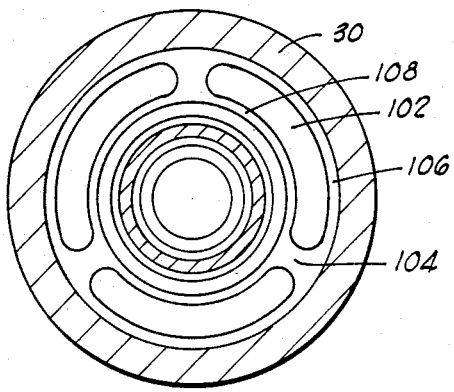
FIG. 2 is a full sectional view taken across FIG. 1A at 2—2, showing the configuration of the support rings employed in the gauge receptacle means of the present invention.

Inside outer housing 90 are an inner housing and a plurality of support rings disposed therebetween. At the top of gauge receptacle means 10, top support ring 100 having a plurality of longitudinal apertures 102 therethrough extends radially outward to abut bore wall 32 and annular wall 22. FIG. 2 shows the configuration of apertures 102, separated by integral radially extending legs 104 which extend between outer shell 106 and inner adapter 108.

Inner adapter 108 is threaded to tubular landing nipple 110 and 112. Landing nipple 110 has a substantially uniform exterior 114, which extends from its upper to its lower end. The interior of landing nipple 110 comprises entry bore wall 116, which necks down to landing bore 118 having annular landing grooves 120, 122 and 124 therein. These grooves may be preferably configured substantially identically to a "Type R" Otis Landing Nipple produced by Otis Engineering Corporation of Dallas, Tex., or may be of other landing nipple configuration as is known in the art. Below grooves 120, 122 and 124 the interior of landing nipple 110 flares slightly to exit bore 126.

Landing nipple 110 is threaded at 128 to flow tube assembly 130, which comprises middle support ring 132 and flow tube 134. Middle support ring 132 is similar in configuration to top support ring 100, having apertures 136 therethrough and an outer shell and an inner adapter (unnumbered) with integral radially extending legs therebetween. Flow tube 134 is welded to ring 132 at 138, and possesses a substantially uniform cylindrical exterior 140 and a substantially uniform interior defined by flow bore wall 142. The outer edge of the lower end of flow tube 134 is beveled as shown at 144.

Flow tube 134 extends downward from middle support ring 132 through first and second substantially identical lower support rings 150 and 160. Support ring 150 has longitudinal apertures 152 therethrough and integral radial legs extending between inner shell 154 and outer shell 156. Support ring 160 possesses longitudinal apertures 162 and integral radial legs extending between inner shell 164 and outer shell 166. Ring 150 is maintained in longitudinal position between step 52 of middle case 40 and annular wall 64 of lower case 60, which ring 160 is maintained in longitudinal position by step 72 of lower case 60, and annular wall 84 of lower adapter 80.

Top support ring 100, landing nipple 110, flow tube assembly 130 and lower support rings 150 and 160 comprise inner housing 170. The substantially annular passage between inner housing 170 and outer housing 90, created by support rings 100, 132, 150 and 160 of inner housing 170, is hereinafter referenced by numeral 180.

Referring again to FIGS. 1A–1D, locking mandrel 190 is shown in position, locked into landing nipple 110. Locking mandrel 190 as shown is an Otis "Type R" Locking Mandrel produced by Otis Engineering Corporation of Dallas, Tex. and is the preferred locking mandrel to use with the landing nipple configuration of choice. However, other locking mandrels known in the art may be employed, such as the Otis "Type X," with a suitably configured landing nipple, or landing nipples and locking mandrels manufactured by other companies and in use in the industry. Locking mandrel 190 comprises a fishing neck at its top end, said fishing neck having annular recess 193 on its interior, with annular shoulder 191 thereabove and annular shoulder 195 therebelow. Below the fishing neck on the exterior of locking mandrel 190 is dog case 194 of cylindrical configuration, dog case 194 having a plurality of sets of longitudinal spring retainer apertures 196, spring expansion slots 198 and dog recesses 200 substantially evenly spaced about the circumference thereof. Dog case 194 is secured to mandrel case 202 at threads 201. Mandrel case 202 extends upward at 204 inside of dog case 194 to the edge of annular shoulder 195, extension 204 having at least one relief aperture 206 therein near its lower extent. Below extension 204, mandrel case 202 has a shear pin aperture 208 through the wall thereof leading from its interior 210 to its exterior. Annular packing 212 is disposed on annular undercut 214 on the exterior of mandrel case 202. As may be seen in FIG. 1B, packing 212 creates a seal between locking mandrel 190 and landing nipple 110 when locking mandrel 190 is in the position shown.

Double acting springs 220 are disposed in spring expansion slots 198, the upper radially outwardly bent ends 222 thereof being retained in retainer apertures 196. Double acting springs 220 each have two substantially straight sections 224 and 226 oriented at substantially the same acute angle to the axis of locking mandrel 190, and laterally offset by oblique section 228, the purpose of which will be explained in conjunction with the operation of the present invention.

Locking dogs 230 are disposed in dog recesses 200, and each comprise three keys 232, 234 and 236, of substantially matching configuration to annular grooves 120, 122 and 124 of landing nipple 110. Key 234 has aperture 238 cut thereinto, lip 240 protruding upwardly from key 236 thereinto. The lower ends 229 of springs 220 extend into apertures 238 and over lips 240.

Tubular expander mandrel 250, secured to fishing neck 192 at threads 252 (shortened in FIG. 1A for convenience) extends downward between dog case 194 and mandrel case 202 under spring retainer apertures 196, expansion slots 198, to substantially near the bottom of dog recesses 200, proximate relief aperture 206. Annular shoulder 254 projects radially outwardly from the bottom of expansion mandrel 250.

Connector 260 connects locking mandrel 190 to shock absorber 270 at threads 262 and 264, respectively. Shock absorber 270, is not essential to the operation of the present invention, but is preferably employed to cushion any shocks experienced by a gauge in gauge holder 280 carried by locking mandrel 190. Shock absorber 270 preferably comprises a "Type LO" spring type double acting shock absorber produced by Otis Engineering Corporation, in order to cushion both upward and downward shocks.

Shock absorber 270 is connected at threads 272 to top bumper holder 282 of gauge holder 280. Bumper holder 282 is connected to tubular gauge housing 290 at threads 284. Gauge housing 290 has a plurality of apertures 292 and 294 about its circumference, to expose gauge chamber 296 to well bore conditions. Elastomeric top bumper 300 is disposed in gauge housing 290 adjacent top bumper holder 282, maintained in position by bolt 302.

Nose 310 is threaded to the bottom of gauge receptacle 290 at threads 298. Nose 310 has a lower frustoconical exterior 312, and lateral ports 314 leading to central passage 316 which extends upward into gauge chamber 296 through hollow bolt 320 which maintains lower bumper 330, preferably of an elastomeric material, in place.

OPERATION OF THE PREFERRED EMBODIMENT

Gauge receptacle means 10 is incorporated in a pipe string run into a well bore, for purposes of illustration and not by way of limitation, in a testing string with a ball type tester valve above it and at least one packer below it. For example and not by way of limitation, the tester valve may be a Halliburton FUL-FLO® HYDROSPRING® tester, or a Halliburton APR®N tester, both produced by Halliburton Services of Duncan, Okla. and described on pages 4003–4005 of Halliburton Services Sales and Service Catalog Number 41. Both of these tools employ a rotating ball with a central bore therethrough as a valve element to open and close the testing string thereabove to formation fluid. The packer may comprise a Halliburton RTTS Hook Wall Packer, described on page 3997 of the previously referred to Halliburton Services Sales and Service Catalog Number 41, or a Halliburton NR Expanding Shoe Well Packer Assembly, described on page 3998 of the same catalog. The RTTS Hook Wall Packer would be employed for testing in a cased hole, while the NR Expanding Shoe Well Packer Assembly would be used in an open hole test. Of course, there would be additional components in the testing string, all of them well known to one of ordinary skill in the art, such as a slip joint, a circulating valve, an hydraulic bypass, a safety joint, an hydraulic jar, a choke, etc. However, these tools are not associated with the operation of the present invention nor germaine to an understanding of its advantages over the prior art, and have therefore not been illustrated and will not be discussed further.

Returning again to the operation of the present invention, the testing string is run into the well bore with the tester valve closed, and the packer set by manipulation of the string when the level of the formation to be tested is released (of course, if the test operator wished to isolate the formation to be tested from well bore both above and below, two packers would be employed). As the gauge receptacle means 10 is run into the well on the string, locking mandrel 190 with its associated gauge holder 280 may or may not be locked into landing nipple 110. For purposes of illustration it is assumed that it is in place as the testing string is run into the well bore.

After the packer or packers are set, the ball type tester valve is opened by string manipulation or application of pressure to the well bore annulus (depending on the type of tester employed) and the formation is allowed to flow therethrough into the test string. After a period of time determined by the operator, the tester valve is closed again, and formation pressure permitted to build. During the test, the temperature and pressure of the flowing well fluid is measured with respect to time by a suitable gauge in gauge chamber 296, such as the Geophysical Research Corporation EMR 502/EPG 520 memory gauge system. The gauge is held in position and cushioned by bumpers 300 and 330. Of course, the bumpers are configured to hold the desired gauge, and may be of any suitable configuration. Of course, other parameters such as resistivity or density of well bore fluid could be measured or a sample of fluid taken with a suitable instrument in gauge chamber 296. The pressure and temperature in the well bore is transmitted through the well fluid to the gauge through apertures 292 and 294 in gauge holder 290, and lateral ports 314 and central passage 316 in nose 310.

After the well has been flowed and closed in again one or more times, the operator may wish to retrieve the gauge in gauge chamber 296 to review test data and ensure the well bore parameters of concern are properly measured before pulling the entire testing string. Alternatively, the operator may wish to treat the formation with a treatment known in the art, for example, acidizing or fracturing, and then retest the formation to ascertain the success of the treatment by running the gauge into the testing string again on wireline. Furthermore, the operator may in some instances wish to retrieve the gauge, perforate another formation below the upper packer, and re-test the well with both formations flowing.

To pull the locking mandrel 190, shock absorber 270 and gauge holder 280, an appropriate pulling tool is run into the well on a wireline and the tester valve is opened to permit passage thereof. For pulling of the preferred embodiment locking mandrel 190, an Otis "Type GR" wireline pulling tool is employed. To use the Type GR Pulling Tool, it is lowered into the string through the open tester valve until it enters the dog chamber 189 defined by recess 193 at the top of locking mandrel 190.

Figure 1B:
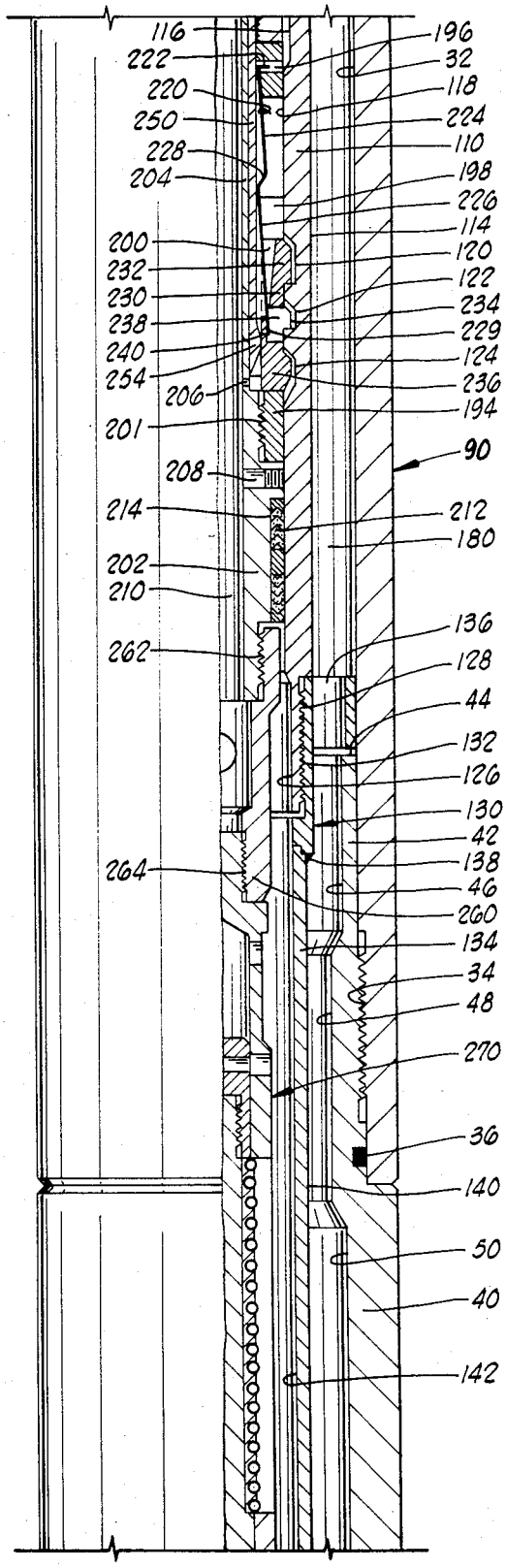
Figure 1C:
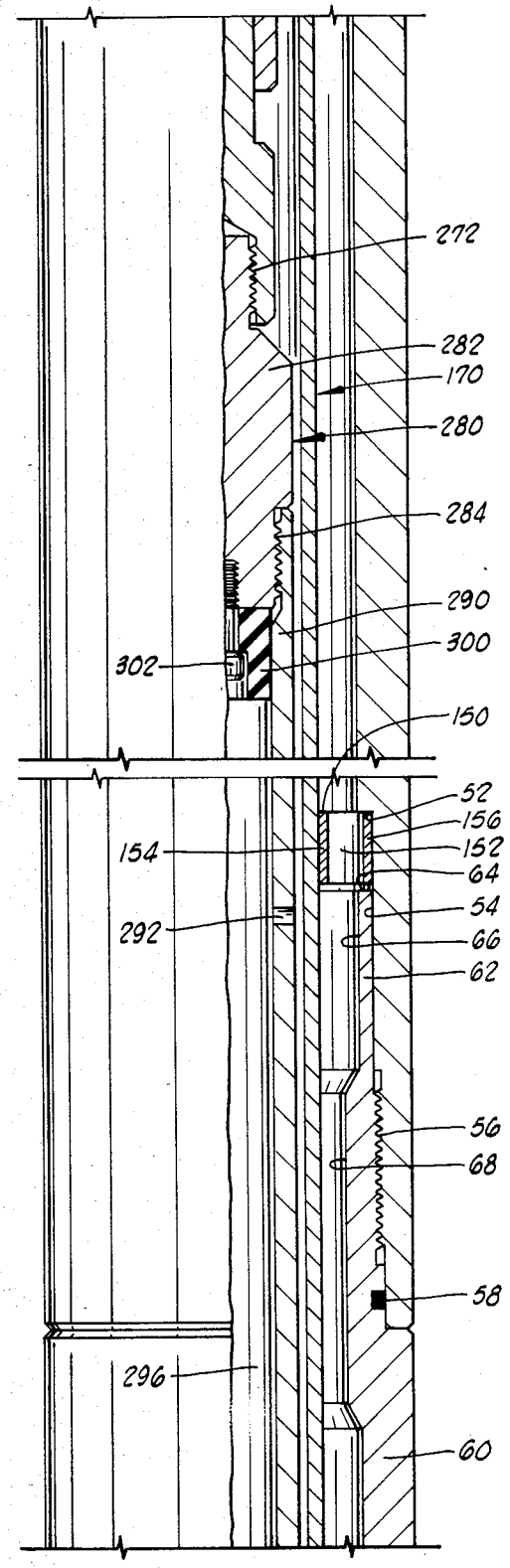
Figure 1D:
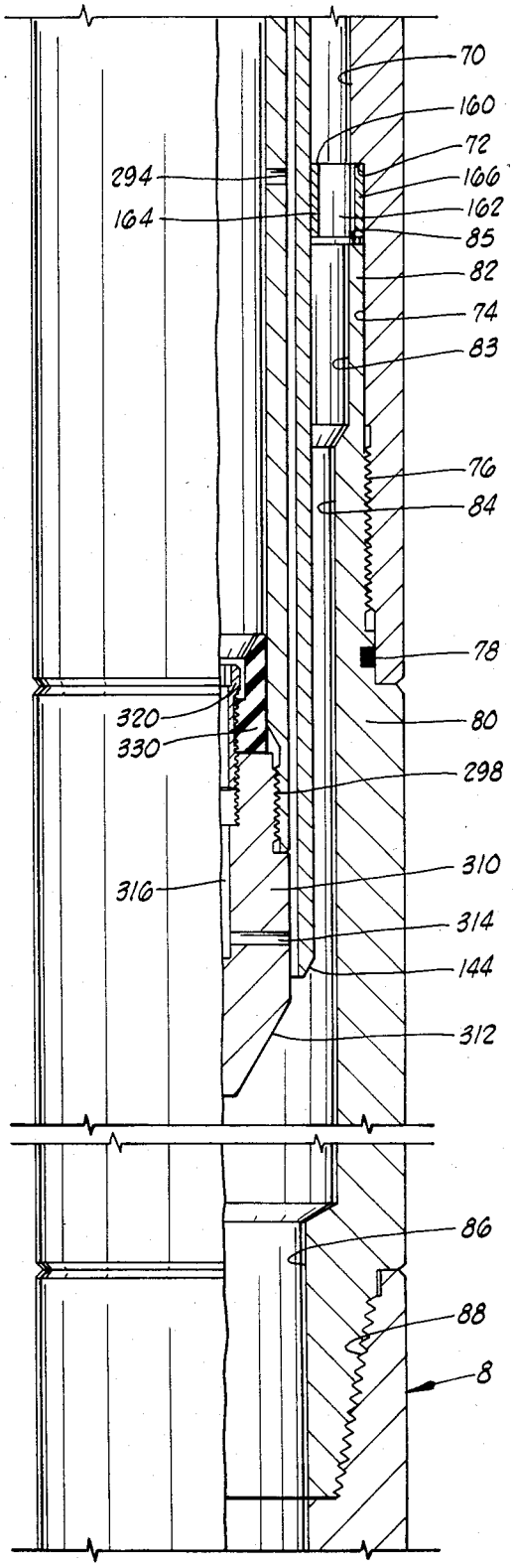

An upward pull on the wireline shears a pin in the pulling tool, causing locking dogs therein to expand outwardly and engage the walls of recess 193, whereupon the wireline is continued to be pulled upward, the pulling tool locking dogs being held in recess 193 by contact with top shoulder 191, expander mandrel 250 being pulled upward in the annular area between mandrel case 202 and dog case 194, so that annular shoulder 254 of expander mandrel 250 moves upwardly from the position shown in FIG. 1B to a position under oblique sections 228 of double acting springs 220, thereby retracting locking dogs 230 from landing nipple 110 due to the radially inward force applied by lower ends 229 of springs 220 to lips 240 on locking dogs 230. The locking mandrel 190 with shock absorber 270 and gauge holder 280 are then pulled from the well bore on the wireline, the tester valve closed after passage therethrough of the locking mandrel 190 with shock absorber 270 and gauge holder 280, and data is taken from the gauge in gauge chamber 280 by means known in the art. For purposes of illustration only, it is assumed that the operator wishes to treat the formation tested, and re-test the formation after treatment to ascertain if production of well fluid has been enhanced, and if so, to what degree. A second gauge or the same gauge cleared of data is then placed in gauge chamber 296 of gauge holder 280, and locking mandrel 190 is placed on the end of a suitable wireline running tool, such as an Otis "Type R" Wireline Running Tool, as used in the petroleum industry, and run down through the tester valve, which is opened to allow passage of the wireline, to gauge receptacle 10. The running tool holds the locking dogs 230 of the lock mandrel 190 in a retracted position until it is lowered through landing nipple 110 of gauge receptacle means 10. The running tool is then pulled upward into landing nipple 110, locating dogs on the running tool catch on the bottom of landing bore 118 of landing nipple 110, requiring a significant force on the wireline to pull the running tool up through landing nipple 110. This force is transmitted through the locating dogs to the locking dogs 230 of the locking mandrel 190 which are expanded as the running tool and locking mandrel 190 are pulled through the landing nipple. The running tool and locking mandrel are then lowered back into the landing nipple, where the radially flat bottom edges on keys 232 and 234 engage the radially flat bottom surface of grooves 120 and 122. A downward jarring action on the running tool shears a first shear pin in the running tool and allows the expander mandrel 250 to be driven behind the locking dogs 230, securing locking mandrel 190 to landing nipple 110. At the same time, retainer dogs on the running tool which have engaged recess 193 in locking mandrel 190 are retracted. An upward strain on the wireline indicates that locking mandrel 190 is set. A sudden upward pull, which produces an upward jarring action, then shears a second shear pin securing locking mandrel 190 to the running tool. Shear pin aperture 208 is the point of engagement of the shear pin with locking mandrel 190. With the new gauge in place in gauge chamber 296 in gauge holder 280, the test may be repeated and the locking mandrel/shock absorber/gauge holder assemblies retrieved once again if desired, to ensure that proper data has been obtained before pulling the testing string.

Otis Engineering Corporation wireline running tools and pulling tools and an Otis lock mandrel and landing nipple configuration have hereby been employed for purposes of illustration; it should be understood that this example is not intended to limit the invention or the tools which may be used in conjunction therewith, as any suitable tools of this type effecting equivalent results may be employed. Moreover, the foregoing example wherein the locking mandrel and associated gauge holder were initially run into the well bore with the testing string is only illustrative and not intended to so restrict the method of the present invention.

While the method and apparatus of the present invention have been disclosed in terms of a preferred embodiment, it will be readily apparent to one of ordinary skill in the art that certain additions, deletions and modifications to the present invention may be made without departing from the spirit and scope of the claimed invention. For example, more than one gauge holder may be run on a single locking mandrel; several gauge receptacle means may be placed in a testing string to receive a like number of locking mandrels and gauge holders; the gauge receptacle means is not limited to use with a testing string, but may be run in any suitable pipe string; treating or perforating operations may be run with the gauge receptacle means in place.

I claim:

1. A gauge depositing means for use in a pipe string disposed in a well bore below a valve included in and having a lesser bore diameter than said pipe string, comprising:

a gauge receptacle incorporated in said pipe string below said valve, said gauge receptacle including:

a substantially tubular outer housing having thread means at its top and bottom adapted to mate with thread means of said pipe string whereby said gauge receptacle is incorporated in said pipe string;

a substantially tubular inner housing within and substantially coaxial with said outer housing, and inner and outer housings defining a substantially annular channel therebetween, the inner housing having an upper and lower end whereby the interior of the inner housing communicates with said annular channel;

a plurality of support means having substantially radially extending legs separated by longitudinally extending apertures, disposed between and secured to both said inner housing and said outer housing, said outer housing, inner housing and support means comprising an integral structure;

landing means associated with the interior of said inner housing, said landing means comprising at least one substantially annular groove in the bore of said inner housing; and locking mandrel means adapted to carry said gauge, said locking mandrel means including locking dogs configured to detachably mate with said at least one annular groove and fishing neck means adapted to be selectively engaged and disengaged by a running tool, said locking mandrel means having associated therewith:

gauge housing means having a generally tubular configuration and at least one means for communicating from the exterior to the interior thereof, whereby well fluid can act upon a gauge contained by said gauge housing means; and double-acting shock absorber means disposed between and secured to both said locking mandrel means and said gauge housing means;

said running tool, said locking mandrel means, said gauge housing means and said shock-absorber means sized to travel through the bore of said valve.

* * * * *